United States Patent [19]

Stockman

[11] 4,280,554

[45] Jul. 28, 1981

[54] HEAT TUBE

[75] Inventor: Richard F. Stockman, Friendship, N.Y.

[73] Assignee: The Air Preheater Company, Inc., Wellsville, N.Y.

[21] Appl. No.: 118,347

[22] Filed: Feb. 4, 1980

[51] Int. Cl.[3] ..... F28D 15/00

[52] U.S. Cl. ..... 165/11 R; 165/76; 165/DIG. 12; 165/104.21; 165/104.26

[58] Field of Search ..... 165/105, 11, 76, DIG. 12

[56] References Cited

U.S. PATENT DOCUMENTS

| | | | |
|---|---|---|---|
| 1,725,906 | 8/1929 | Gay | 165/105 X |
| 4,149,588 | 4/1979 | Waters | 165/105 X |
| 4,177,858 | 12/1979 | Daman et al. | 165/11 |

*Primary Examiner*—Albert W. Davis
*Attorney, Agent, or Firm*—Wayne H. Lang

[57] ABSTRACT

A heat pipe heat exchanger in which heat is transferred from hot fluid in duct 12 to cold fluid in duct 14 by a continuous cycle of evaporation and condensation of a liquid contained in heat pipe 26. Should the heat pipe not function properly, the transfer of heat to that portion of the heat pipe lying in the duct for cold fluid will be reduced partially or completely. This reduction in temperature at the end of the heat pipe lying in the duct for the cold fluid is immediately sensed by a thermocouple 54 and indicated upon a gauge 56 which is adapted to identify a particular heat pipe. Repair or replacement of a faulty heat pipe will return each heat pipe to its maximum effectiveness.

6 Claims, 3 Drawing Figures

HEAT TUBE

BACKGROUND OF THE INVENTION

A heat pipe (tube) is a high performance heat transmission device comprising a tubular member containing a vaporizable fluid in which heat is transferred between hot and cold zones by a continuous cycle of evaporation and condensation of the fluid. When it is functioning properly, a heat pipe can operate with a zero leakage so that it is highly desirable for various applications utilizing corrosive fluids or otherwise requiring high effectiveness and low leakage.

Arrangements that utilize heat pipes have been developed in accordance with U.S. Pat. Nos. 1,725,906 and 2,746,725 wherein heat from a hot fluid is transferred to a cooler fluid flowing adjacent thereto. In all cases it is assumed that each heat pipe in the assembly will maintain its high effectiveness indefinitely. Accordingly there is no provision for detecting inoperative heat pipes or replacing the separate units that may lose their effectiveness because of corrosion or erosion. However, due to corrosion, erosion or other physical damage to the several parts, a heat pipe may become damaged and useless to the extent that it may lose the vaporizable fluid therein and thus lose its effectiveness as a heat exchanger.

SUMMARY OF THE INVENTION

This invention therefore provides for an arrangement whereby a heat exchanger comprising an assembly of heat pipes may be maintained at a high state of effectiveness. More specifically, this invention provides an arrangement whereby an inoperative heat pipe in an assembly of heat pipes may be readily detected and then replaced by a fully operative unit so as to maintain the assembly at a high state of operating effectiveness.

DESCRIPTION OF THE PREFERRED EMBODIMENT

Figure 1:
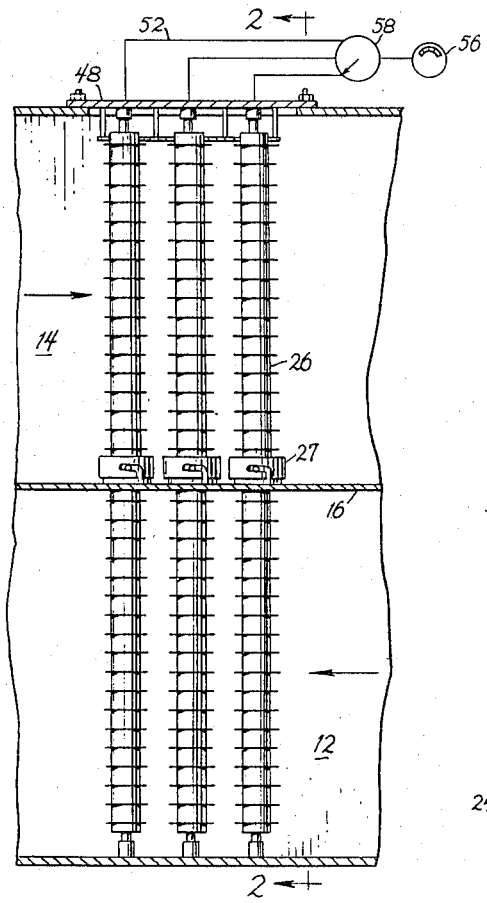
FIG. 1 is a diagrammatic cross-section of a heat pipe that embodies the invention.
Figure 2:
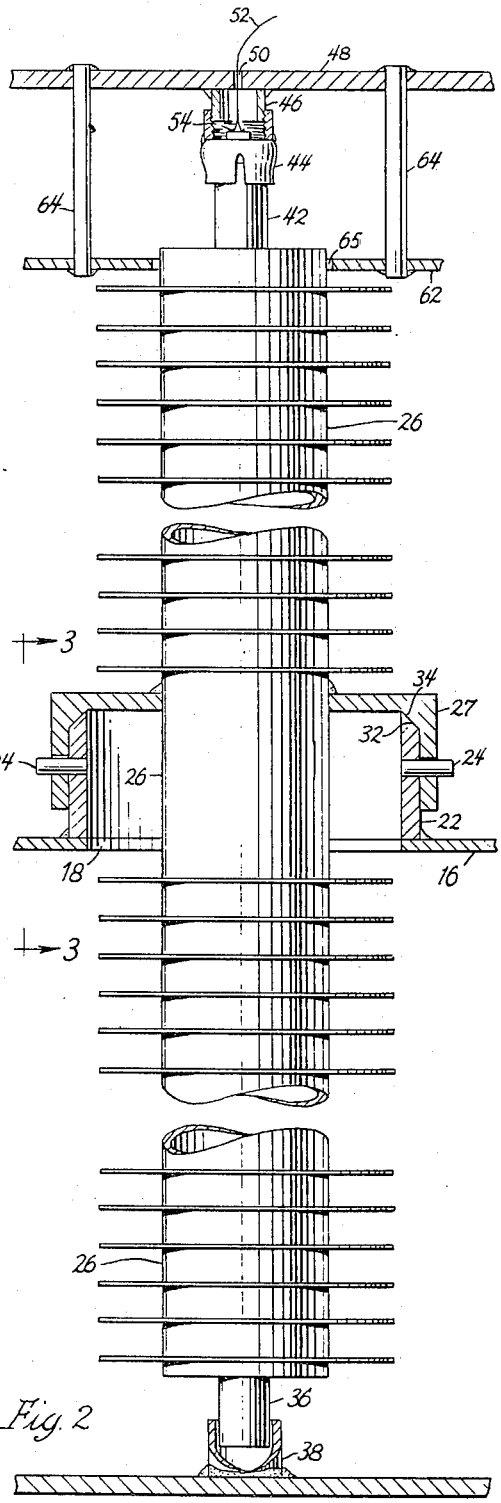
FIG. 2 is an enlarged side elevation of a heat pipe including a cross-section of the suspension means.
Figure 3:
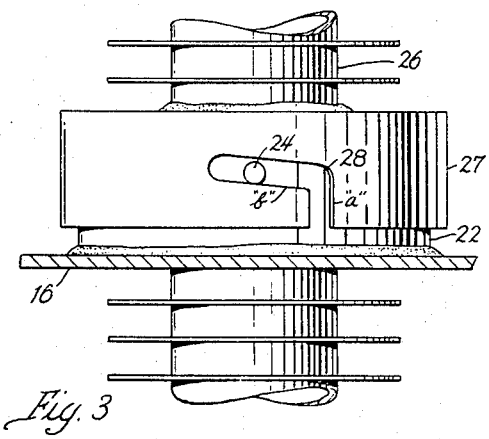
FIG. 3 is an enlarged side elevation of the suspension means.

In the drawings the numeral 12 refers generally to a duct through which hot gases are exhausted from a furnace or other source, while the numeral 14 indicates a duct for the inlet of cool air. The ducts are disposed in juxtaposition whereby the heat contained in the hot gases may readily be transferred to the cooler fluid by the use of a heat exchanger as defined in the accompanying specification.

A common wall of the ducts is provided by a center plate 16 having a series of apertures 18 therein that communicate between ducts 12 and 14. A fixed collar 22 including diametrically oriented pins 24 is welded to the plate around each aperture therein to provide a holding support through which a series of conventional heat pipes 26 may be extended until they reach substantially across the hot and cold air ducts to contact the hot and cold fluids flowing therethrough.

A locking collar 27 is concentrically welded to each heat pipe and provided with an inside diameter only slightly greater than the outside diameter of collar 22 whereby the fixed collar will snugly receive the locking collar in sealing engagement to preclude fluid flow between the ducts for the hot and cold fluids. The locking collar is provided with oppositely oriented slots 28 that cooperate with the pins 24 to draw the locking collar onto the fixed collar, and then hold it in a locked position. The slots each include an axially disposed portion "a" that is adapted to initially receive a pin 24. Upon turning one collar relative to the other, the pins 24 are moved into an oblique slot "b" that produces a camming action sufficient to draw the fixed collar 22 tightly to a tapered seat 34 on the inside of locking collar 27.

Each end of the several heat pipes lying adjacent the outer wall of the duct for hot gas includes a cylindrical boss 36 that is loosely received by a cylindrical pipe guide 38 on the duct wall whereby locating one end of the heat pipe therein will automatically position the entire heat pipe in a fixed position across both ducts for the several fluids.

The ends of heat pipes 26 which lie in the cold air duct therefore extend uniformly outward from center plate 16 toward the outer wall of cold air duct 14. The ends of the heat pipes lying adjacent the outer wall of cold air duct 14 are similarly provided with an upper boss 42 received by a spring cap 44 that is carried by a cylindrical spacer 46 welded to wall 14. An opening outward from the heat pipes 26 is covered by a removable panel 48 that permits easy access to the heat pipes.

The removable panel 48 lying outward from the assembly of heat pipes 26 is provided with spaced apertures 50 that lead into the interior of the cylindrical spacers 46. One end of a conductor 52 leads through each aperture 50 to a thermocouple 54 which is secured to spring cap 44 to thus sense the degree of heat within adjacent heat pipe. The opposite end of each conductor 52 is connected to an indicator or gauge 56 through a selector switch 58 which permits connecting the gauge 56 to a thermocouple in each heat pipe.

The underside of the removable panel 48 includes a spacer plate 62 that has apertures 65 therein positioned and sized to loosely receive the end of the heat pipes of the entire assembly. The spacer plate is suspended in a plane parallel to the wall 48 by a series of hangers 64 that maintain the plate 62 in a predetermined position.

As a matter of convenience, a single gauge 56 may be adapted to indicate the temperature level at a number of thermocouples by interposing a multiple-contact switching means 58 intermediate the single gauge 56 and the thermocouples at the ends of the heat pipes. Thus, a manual rotation of the switching means 58 between the contacts connected to the corresponding thermocouples will provide a direct indication of the temperature at each thermocouple. If a thermocouple should indicate a certain heat pipe as operating at less than optimum temperature, an operator may choose to replace the faulty heat pipe with one of known effectiveness.

After the faulty heat pipe has been located, flow through the ducts is momentarily halted by valve means or a bypass (not shown), and side panel 48 is removed. As this juncture the faulty heat pipe is rotated, removed and then replaced by a new or fully operative tube. As the side panel 48 is replaced and the duct screws thereon are tightened, the spring caps 44 are progressively moved into place on each boss 42 making a direct connection with each heat pipe whereby the signal of each thermocouple 54 will be responsive to the temperature within each respective heat pipe.

I claim:

1. Heat exchange apparatus for the transfer of heat from a hot fluid to a cold fluid including a housing having outer walls enclosing a compartment, an apertured partition plate extending between opposite sides of said housing to divide the compartment into hot and cold fluid passageways, heat pipes extending through each aperture of said partition and substantially across the hot and cold fluid passageways, a volatile liquid contained in said heat pipes, means detachably mounting said heat pipes in the apertures of said partition plate comprising a collar fixed to the partition plate around each aperture therein, a locking collar fixed to each heat pipe adapted to matingly receive the fixed collar on the partition plate to preclude fluid flow therebetween, and means for identifying a heat pipe that fails to effectively transmit heat from the hot to the cold fluid passageways.

2. Heat exchange apparatus as defined in claim 1 wherein the collar fixed to the partition plate around each aperture therein includes pin means that extends diametrically outward therefrom, and a slot in the locking collar adapted to receive said pin means when the locking collar matingly receives the fixed collar of the partition plate.

3. Heat exchange apparatus as defined in claim 2 wherein the slot in the locking collar includes an oblique segment that cooperates with the diametric pin on the fixed collar to produce a camming action that draws the locking collar and the fixed collar tightly together to preclude leakage therebetween.

4. Heat exchange apparatus as defined in claim 3 including a spacer plate apertured to receive the ends of the heat pipe assembly, and hanger means carried by a wall of said housing adapted to support the apertured spacer plate around the ends of the heat pipe assembly.

5. Heat exchange apparatus as defined in claim 4 wherein the heat pipe mounting means on the partition plate and the spacer plate on the housing wall lie in the passageway for the cold fluid.

6. Heat exchange apparatus as defined in claim 5 wherein the spacer plate and passage will comprise an integral side assembly that may be removed to provide access to the assembly of heat pipes, and means removably securing the side assembly to the wall of the apparatus.

* * * * *